US009848751B2

(12) United States Patent
McKenzie

(10) Patent No.: US 9,848,751 B2
(45) Date of Patent: Dec. 26, 2017

(54) REVERSIBLE TUBE TOWEL DEVICE

(75) Inventor: Rebecca McKenzie, Littleton, CO (US)

(73) Assignee: Rebecca McKenzie, Littleton, CO (US)

( * ) Notice: Subject to any disclaimer, the term of this patent is extended or adjusted under 35 U.S.C. 154(b) by 1418 days.

(21) Appl. No.: 13/335,862

(22) Filed: Dec. 22, 2011

(65) Prior Publication Data

US 2012/0204900 A1 Aug. 16, 2012

Related U.S. Application Data

(63) Continuation-in-part of application No. 10/836,168, filed on Apr. 30, 2004, now abandoned.

(51) Int. Cl.

| | |
|---|---|
| ***B08B 1/00*** | (2006.01) |
| ***B08B 7/04*** | (2006.01) |
| ***A47L 13/16*** | (2006.01) |
| ***A47K 10/02*** | (2006.01) |

(52) U.S. Cl.

CPC ..... *A47L 13/16* (2013.01); *A47K 10/02* (2013.01); *Y10T 29/49826* (2015.01)

(58) Field of Classification Search

CPC .... A47K 10/02; Y10T 29/49826; A47L 13/16
See application file for complete search history.

(56) References Cited

U.S. PATENT DOCUMENTS

| | | | | |
|---|---|---|---|---|
| 4,893,372 | A * | 1/1990 | Wenzel | A41D 13/08 15/227 |
| 5,373,601 | A * | 12/1994 | Miller | A47L 13/18 15/118 |
| 6,267,524 | B1 * | 7/2001 | Kroha | A46B 5/04 15/227 |
| 7,141,122 | B2 * | 11/2006 | McKenzie | A47L 13/18 134/6 |
| 2004/0163196 | A1 * | 8/2004 | McKenzie | A47L 13/18 15/227 |
| 2005/0241093 | A1 * | 11/2005 | McKenzie | A47L 13/16 15/209.1 |
| 2006/0097122 | A1 * | 5/2006 | Collins | A47K 5/08 248/317 |
| 2008/0086912 | A1 * | 4/2008 | Wilkenfeld | A43B 13/16 36/92 |

* cited by examiner

*Primary Examiner* — Alexander Markoff

(57) ABSTRACT

An ergonomically designed cylindrically configured wiping towel forming a tube with two open ends, forming a mitt with two openings, and further capable of being constructed with multiple, pre-selected exterior areas of varied colors and patterns for user awareness of soiled portions in order to discourage possible cross contamination. The cylindrically structured tube towel is designed to provide the same amount of cleaning surface as a flat conventional towel in a tubular cavity which encompasses and compacts into a more maneuverable, controlled and tubular device. The cylindrically configured wiping towel turns inside out in order to utilize all towel surfaces.

1 Claim, 11 Drawing Sheets

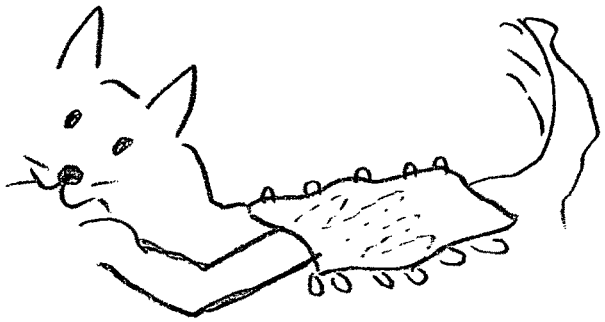
Fig 11 A
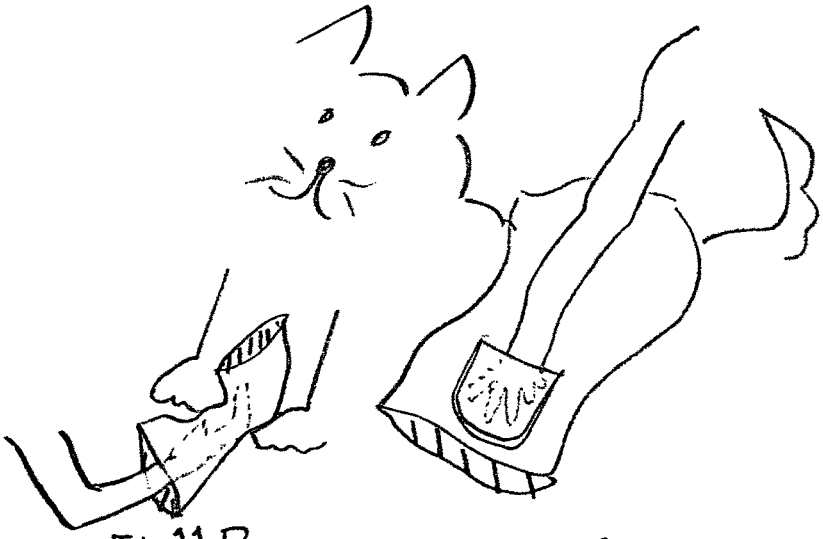
Fig11B
Fig 11C
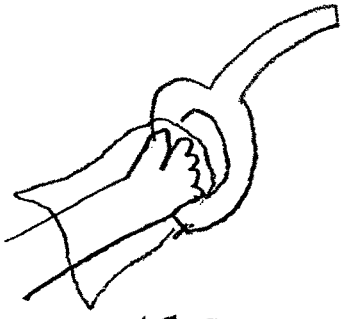
Fig11D

REVERSIBLE TUBE TOWEL DEVICE

This is a continuation in part of earlier filed application Ser. No. 10/836,168, filed Apr. 30, 2004 now abandoned

CROSS-REFERENCE TO RELATED DESIGN PATENT

U.S. D566,970

FEDERALLY SPONSORED RESEARCH

Not applicable

SEQUENCE LISTING OR PROGRAM

Not Applicable

BACKGROUND OF THE INVENTION

Field of Invention

This invention relates to wiping towels relevant to household cleaning or any profession that uses rags or towels for cleanup and especially within the professional cleaning industry. Specifically to an improved wiping towel exhibiting superior control and maneuverability in use as well as unique design features that promote efficient usage of the entire towel surface.

BACKGROUND OF THE INVENTION

Wiping towels are commonly used by professional cleaning companies as well as car washes, janitorial services, window washers etc. and in ordinary household cleaning. The conventional, flat cleaning and wiping towels are generally rectangular or square sheets of absorbent fabric or other material. Most prior art consistently reflects this pattern, sometimes adding chemical treatments and abrasive materials to same. U.S. Pat. No. 5,671,498 to Martin (1997) discloses a scrubbing device providing a first layer of foam material, a second layer of woven synthetic adhered to one another. U.S. Pat. No. 6,692,812 to Watanabe (2004) discloses a multi layer sheet structure comprising a front sheet, a net-like backing sheet and sewing threads for partially joining the front sheet with the backing sheet so as to form bag portions which may be stuffed with pad such as cotton, wool etc. U.S. Pat. No. 5,968,204 to Wise (1999) discloses sheets capable of developing a positive electrostatic charge use for a variety of surface cleaning operations.

My tubular towel provides ergonomically designed construction features providing increased efficiency and ease of use, in a "basic towel" configuration. The most similar article which applicant is aware is shown in U.S. Pat. No. 4,893,372 to Wenzel (1990) which discloses a tubular towel with an elastic band for encircling and gripping a user's arm with an enlarged lower end portion that drapes loosely over the user's hand. My Tube Towel is also of a cylindrical construction, but there, the similarity ends. Wenzels's free-hand tubular towel is worn on the forearm of the user and is retracted onto the arm when not in use. The principal object to provide a towel carried on the forearm and extending over the hand, making it immediately available for use as a wiping towel, of a mitt style. As seen below, my Reversible Tube Towel is much more austere in design relying on the dynamics of its construction, thereby resulting in exceptional efficiency and handling properties of a wiping towel.

The problem with any mitt or duster, is that the one used end used to do the wiping becomes soiled, and the use of the item is finished.

By having open ends for reversing the used end to the back of the arm, or of the device used, an entire new surface for cleaning is available.

When the tubular towel if secured to anther device, the option to turn the tube inside out and reapply to the device is a time saver.

BACKGROUND OF INVENTION

Objects and Advantages

Accordingly, besides the objects and advantages of the Reversible Tube Towel Device described in my above patent, several objects and advantages of the present invention are:

(a) to provide a mitt with two opening so the user's fingers can egress out of the opening as needed and which further is able to provide a wiping towel that handles well;

(b) to provide a mitt with two openings and a wiping towel that easily turns inside out to allow all surface portions to be utilized;

(c) to provide a tubular mitt which also will provide wiping towel that when not encompassing a user's hand or tool will automatically provides a double thickness without folding for exceptional absorbency;

(d) to provide a tubular mitt for stability in a towel that ergonomically responds to a user's hand;

(e) to provide a wiping towel mitt that can encompass a users hand or other tools and can be reversed quickly to use the opposing end;

(f) to provide a wiping towel that can be produced in multiple colors or surface patterns for user awareness of soiled areas of the towel in order to discourage possible cross contamination;

(g) to provide a wiping towel that can be produced in multiple materials for multiple uses having, perhaps, a scrubbing side and a wiping side within the same unit created by adjoining the two panels;

(h) to provide a wiping towel that has sections of differing materials adjoined and adhered to the base tube (I) to provide a multiple versions, sizes, materials in a mitt style tubular wiping device Further objects and advantages are to provide tubular mitt which is capable of being long or short in length because both ends are open providing a tubular wiping-cleaning towel that presents the same amount of cleaning surface area commonly found in a conventional square or rectangular wiping cloth in a towel that occupies a fraction the measurable dimensions of surface area due to its unique construction, the Reversible Tube Towel Device functions in a more compact, maneuverable, controlled manner than other products presently on the market.

Because the towel mitt is worn, the advantages are numerous from providing and excellent controlled mitt, free of material hanging down from the user's hand, and the need to control the material.

The material of the tubular device is secured on the user or a tool, and is easily manageable regardless of size.

The two openings allow for easy exit, entrance into the cavity.

Since either end is an opening, the user does not need to take a moment to find the opening, there are two openings into the tubular mitt.

With one of the user's hands already placed inside of the tube's cavity, the user can easily slide another hand into the cavity through the second opening, and transfer the tubular towel mitt onto the other hand, as well as easily transfer the tube with a hand or tool inserted into the cavity, covering over the items places with in, and then easily transferring the tubular mitt device onto the other.

A very versatile tubular mitt, and tool covering, as well as a towel that is transported on a user's person, or other item for ready recall to place into service.

When the ends are twisted and secured a cavity with closed ends is formed.

A separate clip may be used to secure on of the opening closed

Additionally, other embodiments may be easily formed, to accommodate a variety of shapes in tools, and applications, such that the ends of the tube could be closed, and a slit applied to each end just below the closed end, this would keep a ruler type tool inside, with openings at both ends to let the ruler back out.

Or, the ends are partially closed by means of fastening, either by occurring in the making process, or additionally added as in snaps, hook and loop, or tapering. The ends easily twist, fold, crimp, secure.

SUMMARY

In accordance with the present invention a Reversible Tube Towel Device comprises a cylindrical shaped body forming a tube configuration that easily turns inside out or can be fully or partially reverse-folded over itself to utilize all surface portions while keeping track of soiled portions. It may encompass a users hand, tool, be partially full, or be used flat. The doubled thickness provides superior absorbency and structure providing extra control thereby reducing hand fatigue. The structural dynamics of my Reversible Tube Towel Device result in a more manageable wiping mitt.

DRAWINGS

Figures

In the drawings, closely related figures have the same number but different alphabetic suffixes.

FIGS. 5A to 5*i* show various advantages and ways of using a Reversible Tube Towel Device.

Figure 6A:
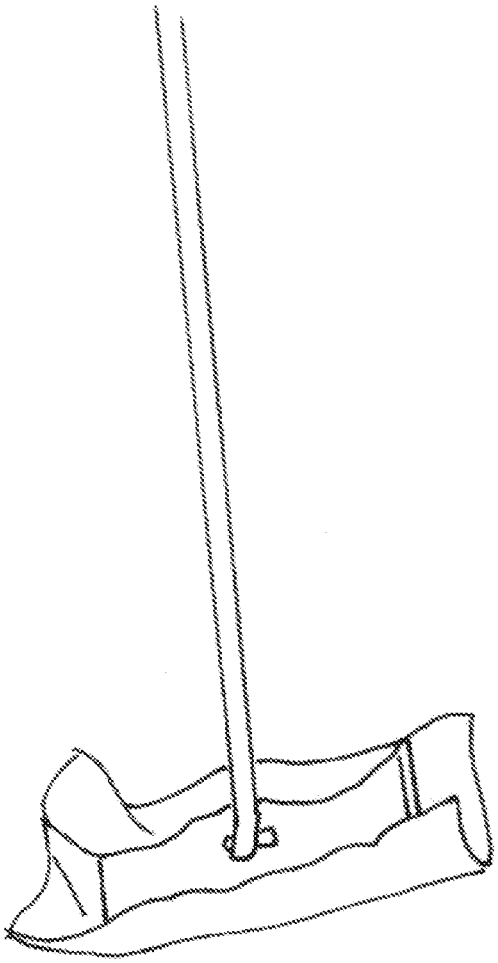
Figure 6B:
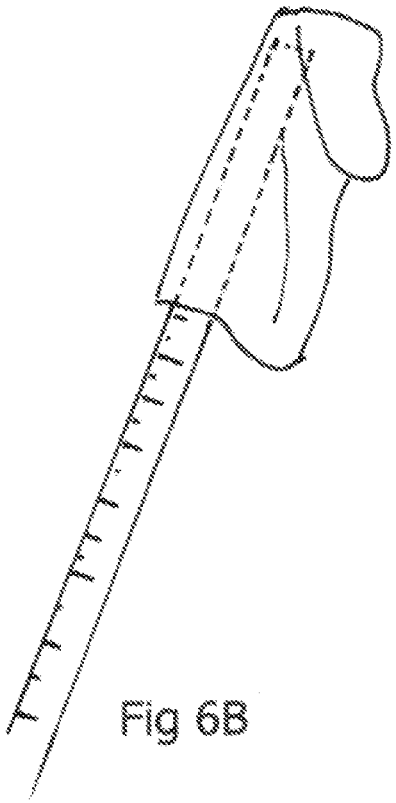
Figure 6C:
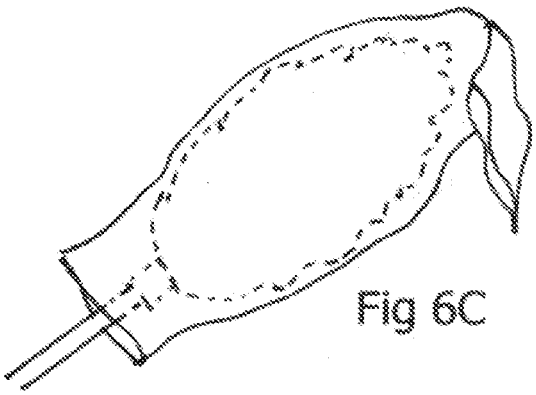

FIGS. 6A to 6C show various uses and functions of a Reversible Tube Towel Device.

FIGS. 7A to 7*i* show means and methods of attaching a Tubular Towel Device to another object, or to itself.

FIG. 8A to FIG. 8E show additional materials to perform other tasks with the tubular device.

FIGS. 9A to 9H show additional embodiments of the tubular device.

FIG. 10A to FIG. 10J show tools with the type or style of tube that would be Useful for an application.

FIGS. 11A to 11D show additional tasks and embodiments

FIGS. 12A to 12C show a tube that has a large long slit on one side, such that the tube is only secured at each opening.

FIGS. 13A to 13F show additions to the tubular device

FIGS. 14A to 14D show some optional methods of carrying or hanging or temporarily using an additional means to secure a tubular device to another item FIGS. 15A to 15C show wadding and twisting and scrunching and tucking the tubular device on a users hand FIGS. 16A to 16F show how to operate the tubular device to form and facilitate other useful devices FIG. 17A to FIG. 17E show the versatility of sizes, styles and options of using the tubular device FIGS. 18A to 18C show other options of use and styles of the tubular device FIGS. 19A to 19E show ways to use the tubular device FIGS. 20A to 20D show how a long tube can be used

DRAWINGS

Reference Numerals

10 base material
12 longitudinal edges
14 end edges
16 seam
18 opening
20 dyed portion
22 patterned portion
24 embroidered portion

DETAILED DESCRIPTION

Figure 1A:
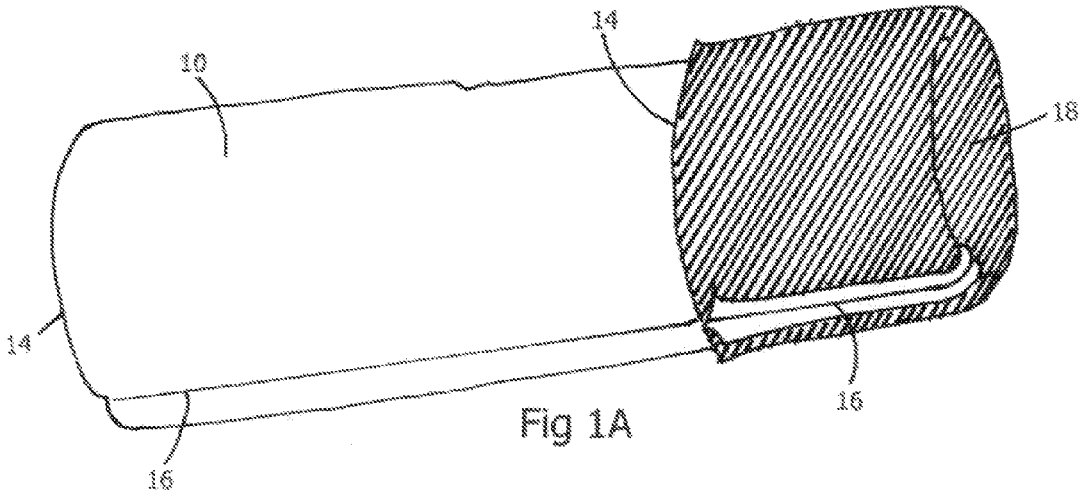
FIGS. 1A and 2A show a perspective view of a Reversible Tube Towel Device

FIG. 1A to-Preferred Embodiment

Figure 1B:
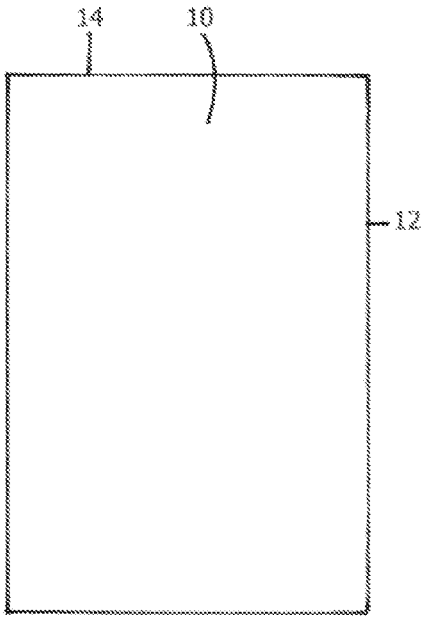
FIGS. 1B to 1D show the construction of a Reversible Tube Towel Device using one flat panel of material.
Figure 1C:
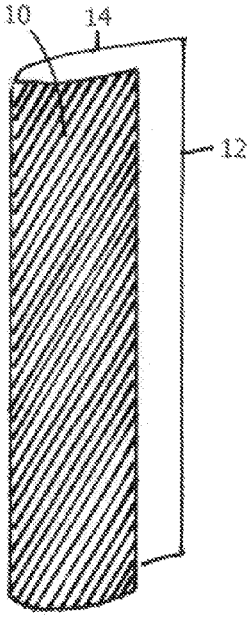
Figure 1D:
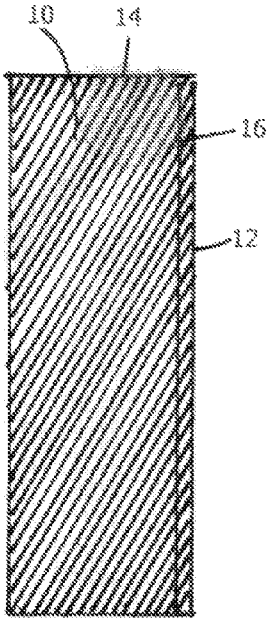
Figure 2A:
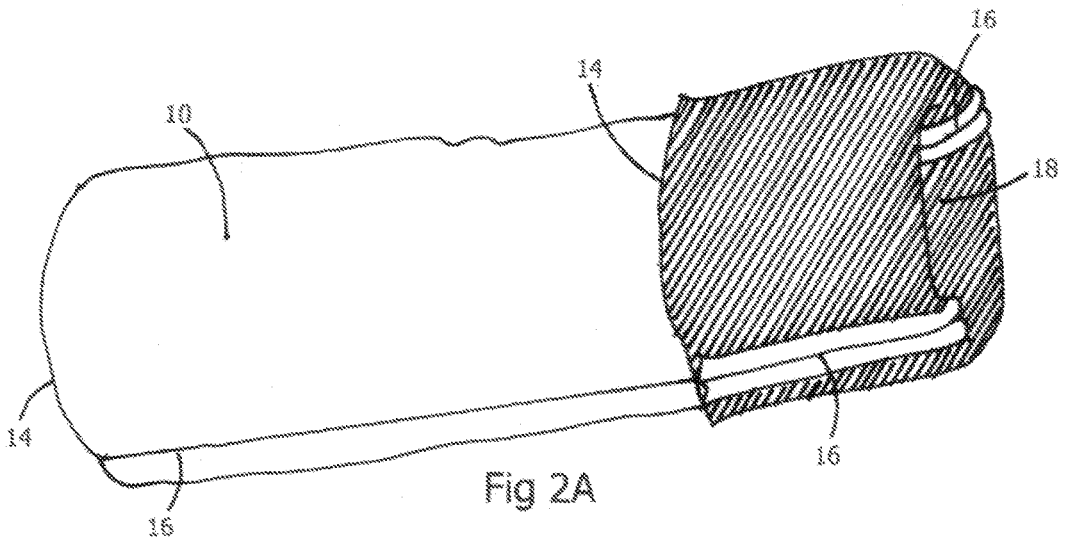
Figure 2B:
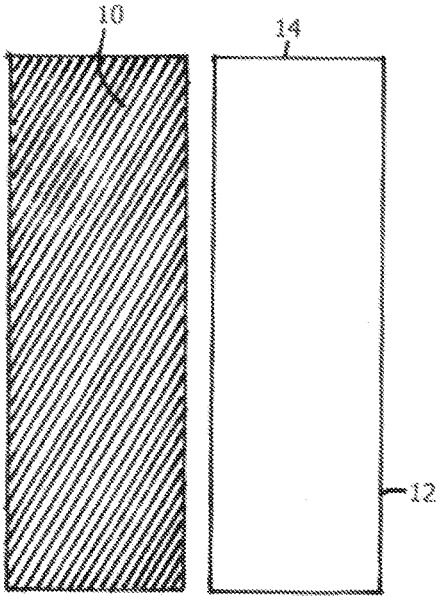
FIGS. 2B to 2D show the construction of a Reversible Tube Towel Device using two equally sized panels of material.
Figure 2C:
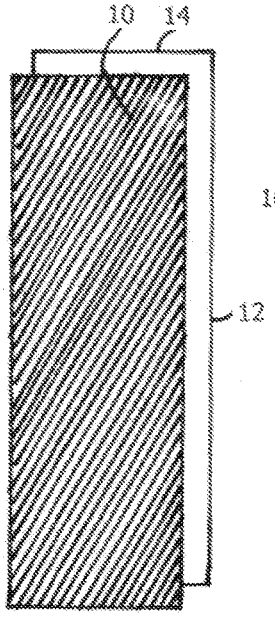
Figure 2D:
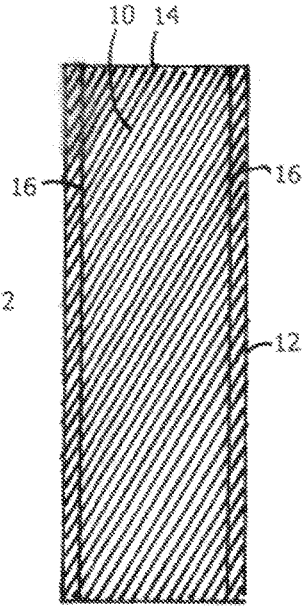

A preferred embodiment of the Reversible Tube Towel Device of the present invention is illustrated in FIGS. 1A and 1B. My Reversible Tube Towel Device, an improved wiping towel, is cylindrical in shape forming a tube configuration, having openings for entry or exit 18 at either end and is adjoined at multiple longitudinal sides 12. FIG. 1A shows a completed one-panel Reversible Tube Towel. FIGS. 1B to 1D show its basic construction utilizing a single panel of base material 10. FIG. 1B shows the panel of base material laid flat. FIG. 1C shows the panel of base material 10 folded once. FIG. 1D shows the two longitudinal edges 12 of the panel joined with a seam 16. FIG. 2A shows a completed two-panel Reversible Tube Towel Device. FIGS. 2B to 2D show its basic construction utilizing two equally sized and configured panels of a base material 10. FIG. 2B shows the two panels of base material side-by-side. An exterior surface is represented on the left with the interior surface indicated on the right. FIG. 2C shows one panel of base material 10 superimposed directly over the second, with the two exterior surfaces facing each other. FIG. 2D shows all four longitudinal edges of the two panels of base material 10 joined with seams.

My Reversible Tube Towel Device may be constructed in any desired material common to wiping or cleaning, scrubbing, exfoliating, drying, brushing, scouring, sanding, such as paper, plastic, wool, cotton, abrasive scrubbing mesh or any other synthetic or natural fiber, static dust cloths, micro fiber, PVA, fleece, flannel, disposable paper product, chamois, plastic, rubbery nubbed material, lint removing fabric, etc. The open ends may be either hemmed or left unfinished.

An elasticized tube may be formed from stretchable material, or as well as knitted.

The dimensions of my finished Reversible Tube Towel Device are established with the width of the towel being measured to be less than the length. A standard Reversible Tube Towel Device specification being approximately 7 to 9 inches in width and approximately 12 to 20 inches in length. A smaller, more compact version of my Reversible Tube Towel Device may be approximately 5 inches in width by approximately 9 inches in length. A larger, automotive wiping size could measure approximately 9 to 10 inches in width and approximately 24 inches in length. And yet other variances in size and dimension would be formed for specific job tasks, or tool covering applications. For example, a 7 by 28 inch works nicely in the kitchen folded over an apron tie. A 7 by 15 inch Reversible Tube Towel Device makes a great dish-drying towel, chef's apron towel, spa towel or polishing towel. A very long towel may be used as a hair drying towel or cinched in the middle for a golfers towel. A small stretch towel is ideal for cosmetic applications and exfoliating. The preferred Reversible Tube Towel Device would accept a user's hand and (or) forearm into the cylinder. A narrower Reversible Tube Towel Device will securely stay on a user's hand by simply spreading the fingers within the confines of the tube. The entire Reversible Tube Towel turns inside out to provide a fresh clean surface.

Optional Construction Features

When a pre-existing material is used in the base of the tube's construction, one or more seams 16 may be used for the purpose of adjoining the longitudinal sides. For one piece of material, one seam 16 as seen in FIG. 1A or for two separate sections of material, two seams 16 as seen in FIG. 2A. However, additional vertical, and (or) horizontal, and (or) diagonal seams 16 may also be incorporated into the device for structural stability or definition.

The tubular towel may also be formed without the use of pre existing panel of material, as in directly formed into a tubular device form fiber For definition of soiled areas, portions of my Reversible Tube Towel Device may be dyed or my Reversible Tube Towel Device may be constructed using multiple colored or patterned panels. This feature provides instant user-awareness of soiled areas of the towel in order to discourage possible cross contamination.

My Design Patent U.S. D566,970 provides an easily recognizable pattern, providing a optional awareness of sequence to the user, such that the diagonal stripes are known to the user as always to begin using with the stripped portion first.

The interior cavity may be a continually known product line such that the variation of lines, always indicate the beginning of the device's use, per inside cavity use, and exterior use.

Or, such that the interior of the product is always known as orange, always, and the outside may be or is always blue or white, or whatever color is designated for the exterior.

Additionally such that the white side, as in this example, may have a small scrubby patch, when the scrubby patch is the desired material wanted for use as the surface of the tubular device, the users knows the desired patch is on the white side.

This concept allows for quick knowledge of the desired portion of the tubular device.

Figure 3A:
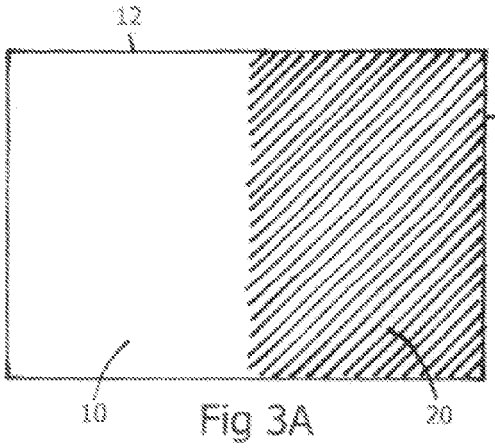
FIGS. 3A to 3F show various applications of color, pattern and construction features as applied to the exterior of single panel and double panel Reversible Tube Towel Device base materials prior to stitching.
Figure 3D:
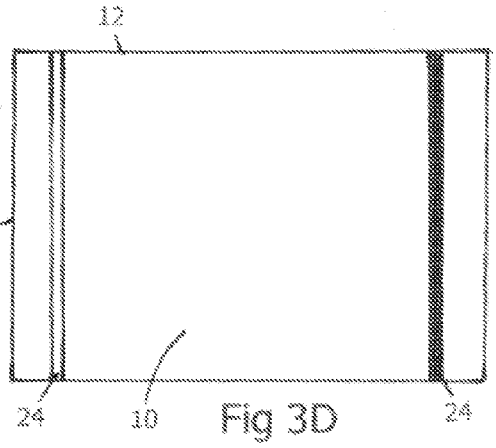
Figure 3B:
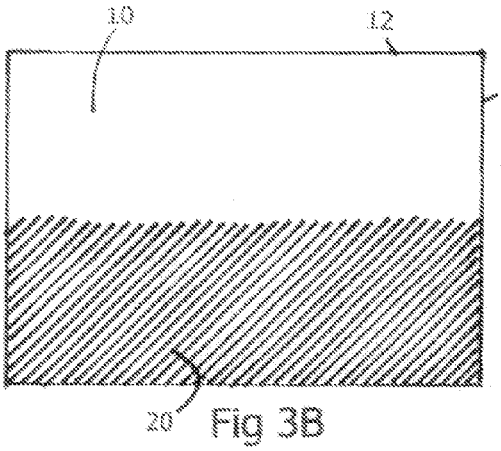
Figure 3E:
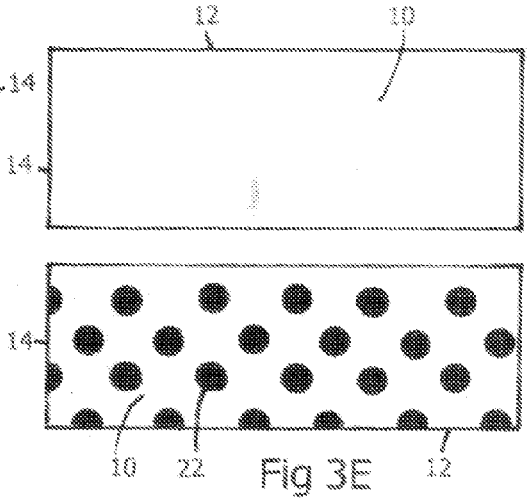
Figure 3C:
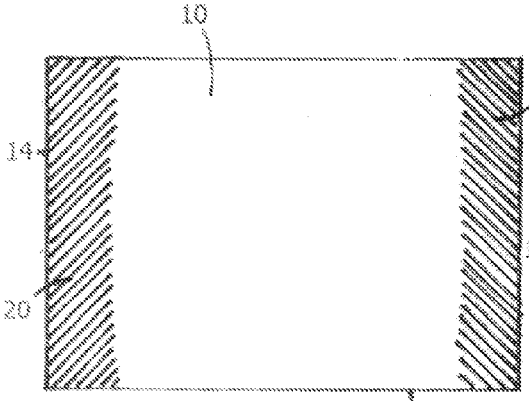
Figure 3F:
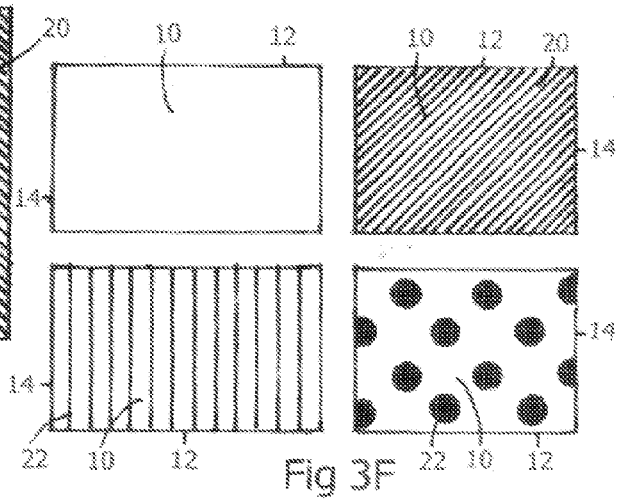

FIGS. 3A through 3F show various optional construction features and exterior treatments that may be applied to my Reversible Tube Towel Device for the purpose of delineation of towel areas in order to discourage possible cross contamination as discussed above. FIG. 3A shows a single panel featuring a dyed portion 20 occurring on one half of the single panel at the end edge 14 resulting in that half of the finished Reversible Tube Towel Device being of a contrasting color. FIG. 3B shows a single panel tube featuring a dyed portion occurring at the length of a longitudinal edge of the panel resulting in one side of the folded and finished Reversible Tube Towel Device being of a contrasting color. FIG. 3C shows a single panel tube featuring dyed portions at both ends, resulting in each end edge 14 being of a contrasting color. FIG. 3D shows a single panel tube having contrasting colors of embroidery 24 occurring at both ends resulting in each end edge 14 exhibiting a contrasting color or pattern. FIG. 3E shows a double panel tube having a contrasting patterned 22 second panel resulting in one side of the finished Reversible Tube Towel being of a contrasting pattern. FIG. 3F shows a double panel tube with contrasting colors and patterns created by dividing and consequently adjoining two halves of contrasting colors or patterns on each panel prior to adjoining their longitudinal sides resulting in a four panel finished Reversible Tube Towel Device having four distinctly contrasting panels. Four or more different contrasting colors or patterns may be incorporated within a Reversible Tube Towel Device in this manner.

Figure 4A:
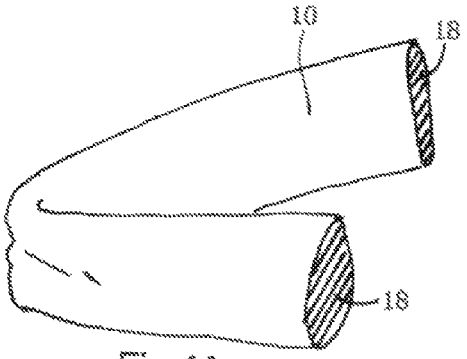
FIGS. 4A and 4B show a knitted version of a Reversible Tube Towel Device.
Figure 4B:
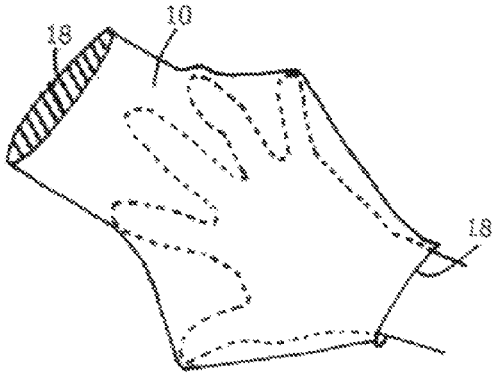

FIGS. 4A to 4B Additional Embodiments

FIG. 4A shows a knitted, elasticized Reversible Tube Towel Device with openings 18 at either end and having no seams. An elasticized version of my Reversible Tube Towel Device could measure approximately 4 inches by 14 inches, with the 4 inch width being expandable to 6 or 7 inches.

Or a small stretchy finger tube could measure 3 inches by 4 inches.

FIG. 4B shows a user's hand inside a Reversible Tube Towel Device. The narrower width of the elasticized body encourages the Reversible Tube Towel to conform and mold to a user's hand when inserted inside the tube structure. The tube measurements should be ample enough to allow the towel to turn inside out for use of the surface of the other side.

Figure 5A:
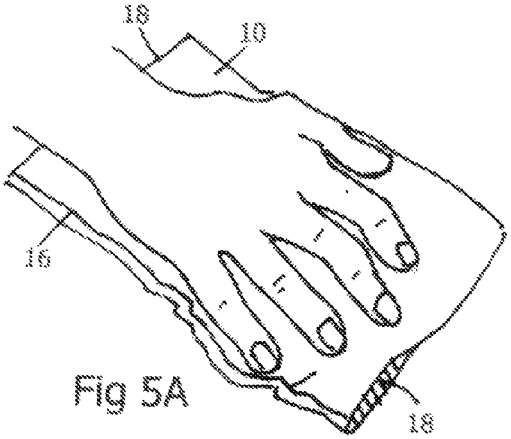
Figure 5B:
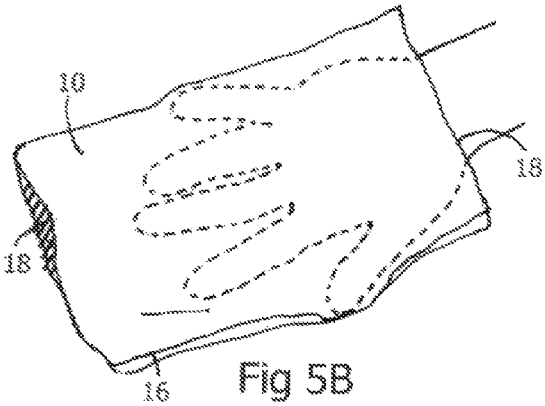
Figure 5C:
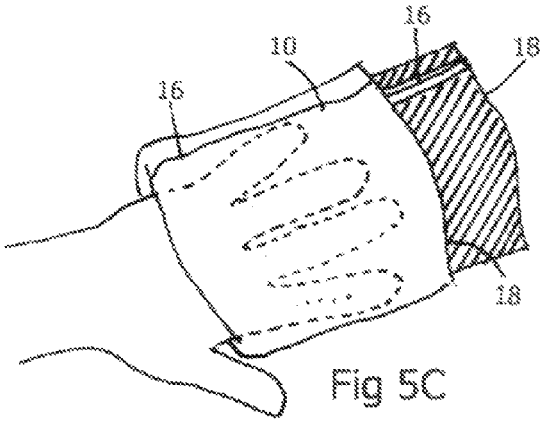
Figure 5D:
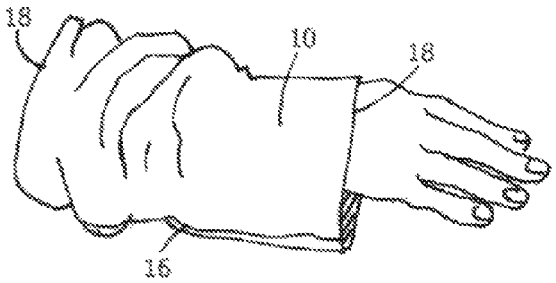
Figure 5E:
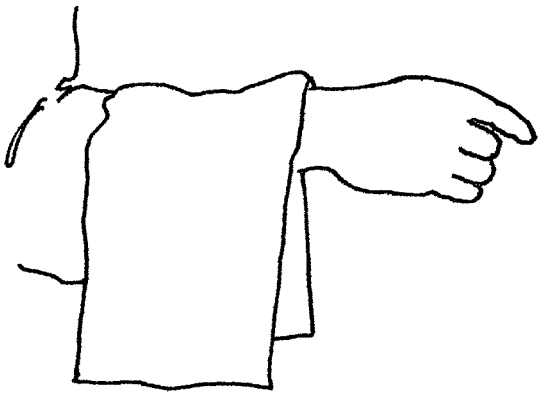
Figure 5F:
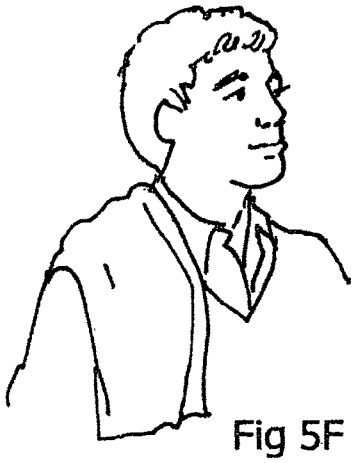
Figure 5G:
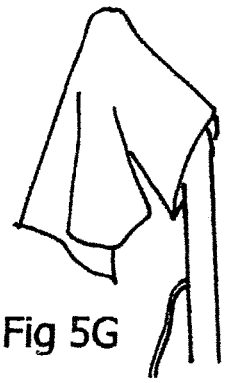
Figure 5H:
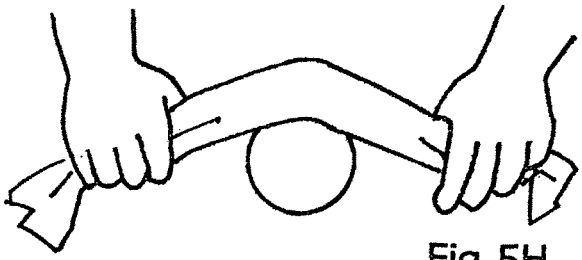
Figure 5I:
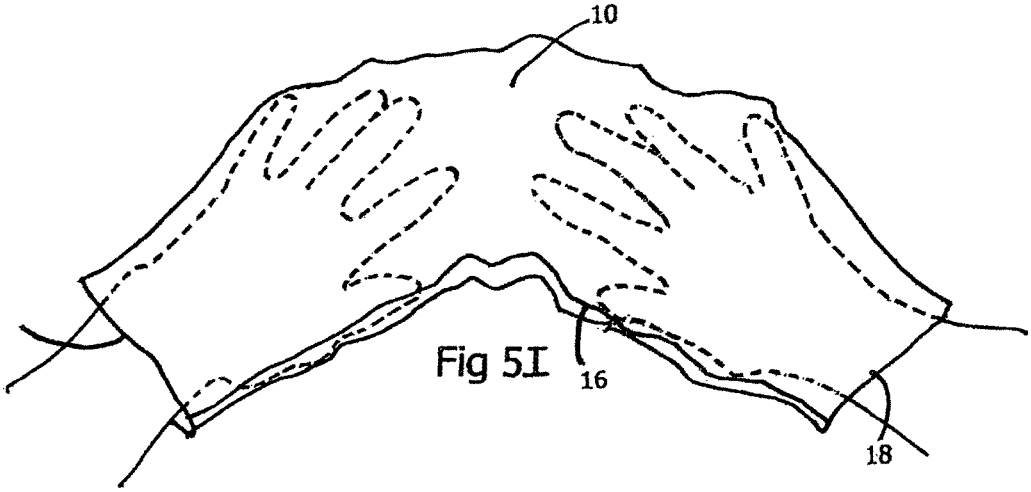

Operation—FIGS. 5A to 5 I

FIGS. 5A through 5 I show my Reversible Tube Towel Device in operation off of a hand or tool. FIG. 5A shows how a user's hand manipulates the towel in normal use. The double thickness of my Reversible Tube Towel Device creates an automatic towel of double thickness without the need to fold first. And the bulk created by the double thickness lends its self to a fuller, yet flexible wiping towel for superior handling and control. FIG. 5B shows a Reversible Tube Towel Device in use with the user's hand inserted in the cavity of the towel. FIG. 5C shows how a Reversible Tube Towel Device may be partially turned inside out in order to double the thickness while a hand is inserted within the cavity of the cylinder. FIG. 5D shows a Reversible Tube Towel Device deposited on the forearm of a user when it is not in use. FIG. 5E shows how the Reversible Tube Towel Device conveniently drapes over the forearm of a user. 5F shows how the unique shape of a Reversible Tube Towel Device naturally drapes over a shoulder for easy access. And FIG. 5G shows a Reversible Tube Towel Device handily resting on the handle of a vacuum. The longer, narrower configuration of my Reversible Tube Towel Device makes it easy to use and convenient to deposit out of the way on a user's person or stationary object when not in use. FIG. 5H shows how an extra long Reversible Tube Towel Device provides leverage for two hands for polishing. FIG. 5 I shows how both hands may be inserted within the cylinder for extra scrubbing power.

FIGS. 6A to 6C show various optional uses for my Reversible Tube Towel Device. The versatility of My Reversible Tube Towel Device is virtually unlimited to use within many other industries such as relating to beauty, hygiene etc. Many sweepers and mops will accept a wiping towel on the mop head. FIG. 6A shows how the Reversible Tube Towel Device easily adapts for use on mop-sweeper heads offering the distinct advantage that the towel can be reversed (turned inside out) and reapplied to the mop head providing a clean surface. FIG. 6B shows the Reversible Tube Towel Device used with an extender such as a yard-stick or broom handle inserted for extra reach. FIG. 6C shows how a Reversible Tube Towel Device may be used to enclose a feather duster or wool duster, or other style of duster.

The open-ended construction feature allows for a tool or a hand to be inserted in either end of my Reversible Tube Towel Device with the option to switch ends when one is soiled. And the tube may then be turned inside out to expose a fresh surface and to be reused.

Figure 7A:
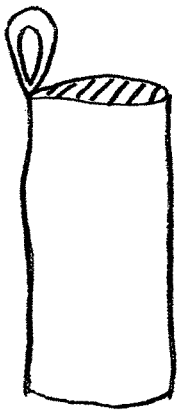

FIGS. 7A to 7 I shows means and methods of attaching a Tubular Towel Device to another object, or to itself.

FIG. 7A shows a single loop attached at one opening

Figure 7B:
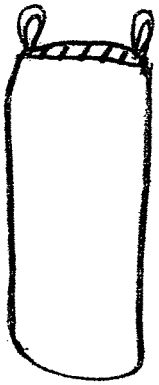

FIG. 7B shows two loops attached at a single opening

Figure 7C:
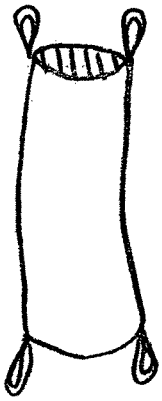

FIG. 7C shows two loops attached at each opening

Figure 7D:
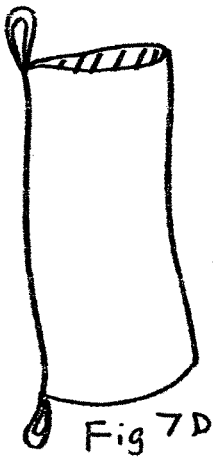

FIG. 7D shows a single loop attached at each opening

Figure 7E:
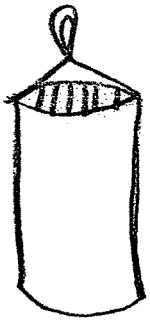
Figure 7F:
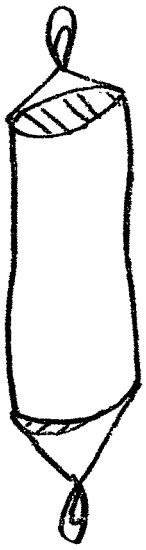
Figure 7G:
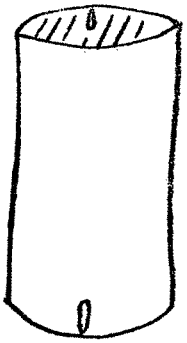
Figure 7H:
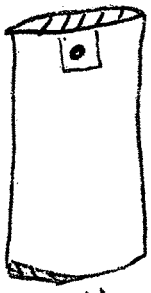
Figure 7I:
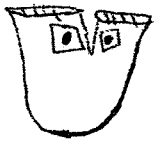

FIG. 7E shows an elasticized cord attached at two points a one of the openings of the tubular device FIG. 7F shows an elasticized cord attached at two points at each of the opening of the tubular device FIG. 7G shows a small slit applied a each opening FIG. 7H shows a magnet attached to an opening of the tubular device FIG. 7 I shows additionally other means of securing such as a Velcro patch or snap may be applied to attach to another item, or to attach one opening to the opposing opening FIG. 8A to FIG. 8E show additional materials to perform other tasks with the tubular device.

Figure 8A:
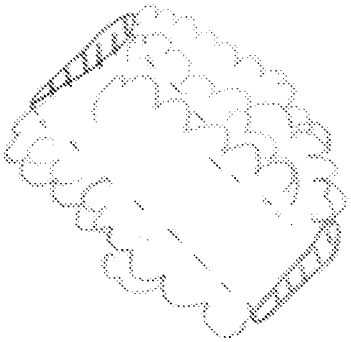
Figure 8B:
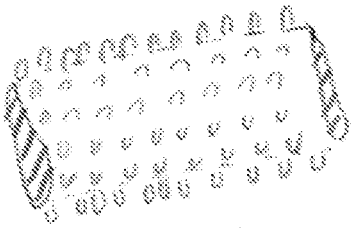
Figure 8C:
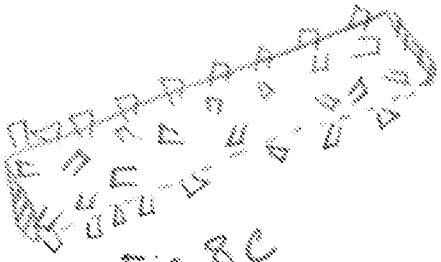
Figure 8D:
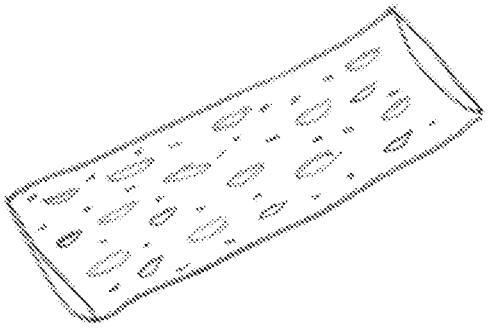
Figure 8E:
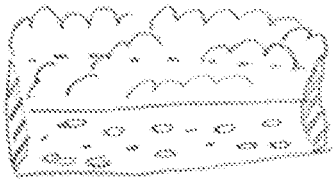
Figure 9A:
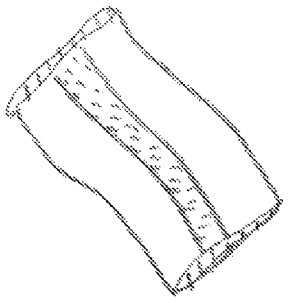
Figure 9B:
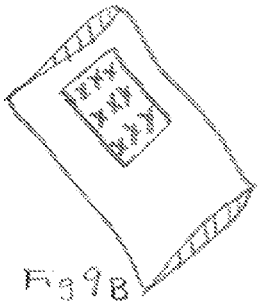
Figure 9C:
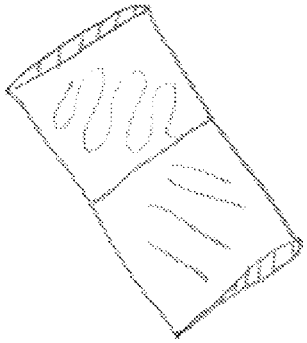
Figure 9D:
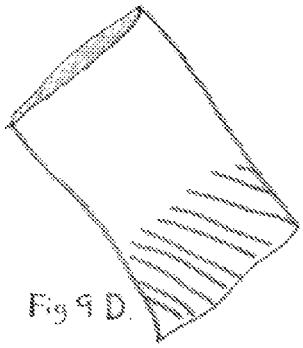
Figure 9E:
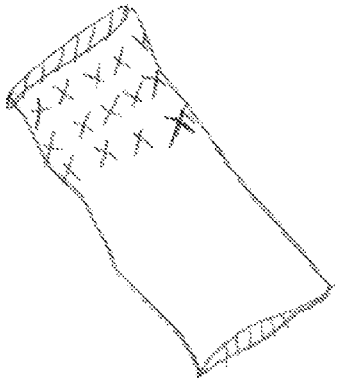
Figure 9F:
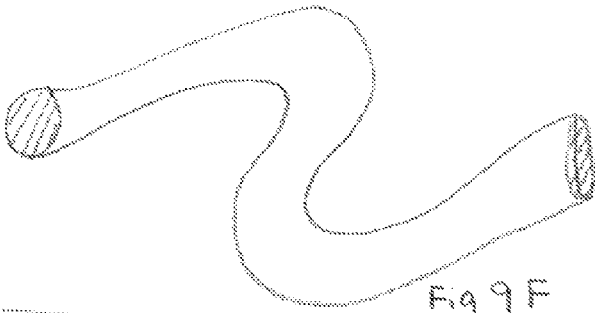
Figure 9G:
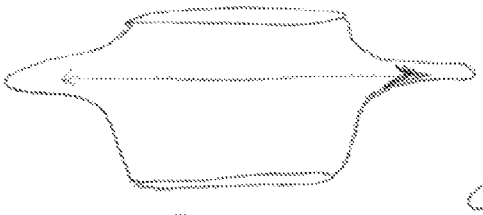
Figure 9H:
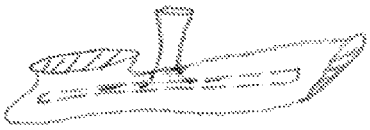
Figure 10A:
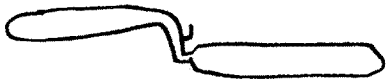
Figure 10B:
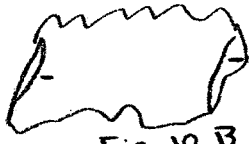
Figure 10C:
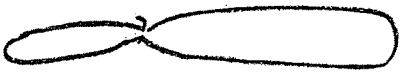
Figure 10D:
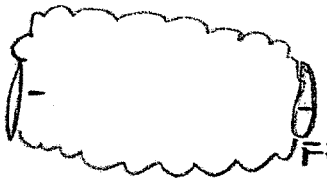
Figure 10F:
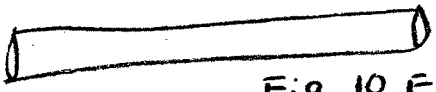
Figure 10E:
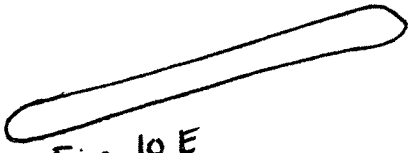
Figure 10H:
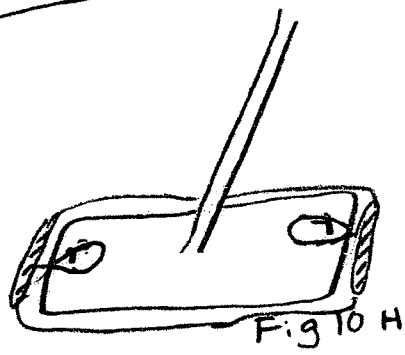
Figure 10G:
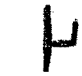
Figure 10I:
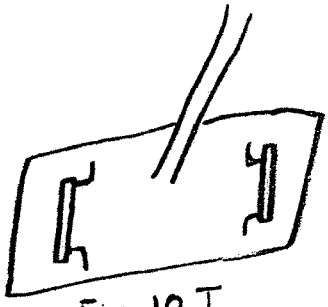
Figure 10J:
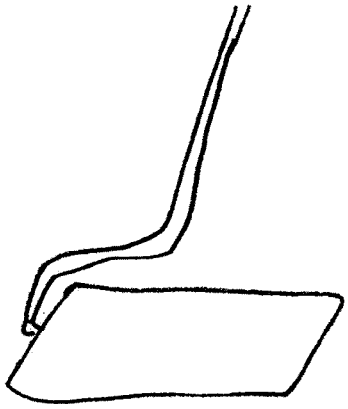

FIG. 8A shows a tube with a lofty fluffy material for washing which has a material base and is not lofty on the interior FIG. 8 B shows a rubbery nubby material for brushing, the tube is not nubby on the interior FIG. 8C shows a synthetic dusting material on the exterior, but is not lofty on the interior FIG. 8 D shows an airy holey mesh net type material FIG. 8 E shows a base tube with a lofty material on one side, and an airy mesh type material on the opposing side FIGS. 9 A to 9G show additional embodiments of the tubular device FIG. 9A shows a mesh net type material added as a panel to form the tube of two materials FIG. 9B shows a scrubby patch attached to the surface of the tubular device FIG. 9C shows two different materials attached to each other to form the tubular device FIG. 9D shows an understood pattern FIG. 9E shows an understood pattern FIG. 9F shows an extremely long and narrow tubular device FIG. 9 G shows a stretches out tube FIG. 9 H shows how a squeegy can be covered by a tubular device FIG. 10A to FIG. 10 J show tools with the type or style of tube that would be useful for an application.

FIG. 10 A shows a tool with a hook or faster to secure a tubular material

FIG. 10 B shows a tube with slits for hooking onto a fastener

FIG. 10 C shows another style of tool for accepting a tube

FIG. 10 D shows possible tubes to attach to a tool such as a lint removing tube, or fluffy duster tube, or possibly a scrubby material tube, a nubby tune, or any desired material.

FIG. 10 E shows yet another tool possible for accepting a tubular device

FIG. 10 F shows a tube that accepts the tool of FIG. 10 E

FIG. 10 G shows a hook or fastener which could accept a tube with a slit or loop.

FIG. 10 H shows a mop head accepting a tubular device with a loop a each opening FIG. 10 I shows a tool which can secure a tube with two loops at each opening FIG. 10 J shows a tool that can secure a tubular device without a means of a secure means other than molding to the item placed within the tubular cavity FIGS. 11A to 11 D shows additional tasks and embodiments FIG. 11 A shows brushing a nubby tubular device FIG. 11 B shows wiping of dirt while protecting the user's hand from being exposed to the soil FIG. 11 C shows a large tube with an attached pocket for inserting a user's hand into FIG. 11 D shows a plastic tube covering and protecting a user's hand from a substance or germs on an item such as a gas pump FIGS. 12 A to 12 C show a tube that has a large long slit on one side, or such that the tube is only secured at each opening.

This provides an additional flexibility for wadding and twisting and securing the tubular device.

This embodiment of the tubular device is excellent for dish washing as the users hand can pop out of the long slit.

FIG. 12A shows the tubular device, and that the inside of the cavity is visible FIG. 12 B shows the openings of the tube pulled up together FIG. 12 C shows the tubular openings twisted and crossed over themselves FIG. 13 A to FIG. 13 F show additions to the tubular device FIG. 13 A shows a tube which is not uniform such that at one of the openings the side area slightly bellows outward and at the other opening there is a narrowing tapering at that end portion FIG. 13 B shows darting at an opening to narrow the entrance into the cavity FIG. 13 C shows a tube with a long slit down the side, and netting applied over a portion of the tubular body for scrubbing purposes FIG. 13 D shows an outside surface and an interior cavity surface to be of differing materials FIG. 13 E shows a scalloping at one of the openings and a ragged edge at the other opening FIG. 13 F shows how a knitted tube is formed from a fiber of thread FIGS. 14A to 14 D show some optional methods of carrying or hanging or temporarily using an additional means to secure a tubular device to another item FIG. 14 A shows a user wearing an elasticized band on an arm FIG. 14 B shows a user wearing a tubular device with the arm in the cavity of the tube and tucking the tubular device under the elastic band FIG. 14 C shows the user wearing an elasticized band and tucking the tubular device under the elasticized bad, with the cavity empty FIG. 14 D shows a hook and loop stick together band cinched around the exterior of the tubular device and a hook or clip for securing the tubular device to another item FIGS. 15 A to 15 C show wadding and twisting and scrunching and tucking the tubular device on a users hand FIG. 15 A shows the user wadding scrunching and twisting the tubular device to form a useful mitt FIG. 15 B shows the above but the user has applied a separate temporary optional additional elasticized arm band to cinch and gather an opening FIG. 15 C shows one of the opening loosely over a users arm and the opposing opening twisted and tucked up under the tubular device itself as mean of shortening the tubular devices length and temporarily securing the tubular device to user's arm area while the users arm is inside the cavity if the tubular device FIGS. 16 A to 16 F shows how to operate the tubular device to form and facilitate other useful devices FIG. 16 A shows how a padded mitt is formed with pocket which allow for a user's had to slid around the interior of the pocket formed by tucking tone end of the tube into the other end and forming a circular pocket FIG. 16 B show how a hook and loop fastener has been added to secure the opening to each other to form the padded mitt FIG. 16 C shows how one end of the tube may be inserted into the other end forming a tubular circle FIG. 16 D shows the tubular circle laid flat which also forms another type of pocket for the user's hand to be inserted into FIG. 16 E shows a tube with an interior cavity of a scrubbing material and how the user flips the cavity outward onto the exterior surface being of a different material so as to have access to two different wiping surfaces at the same time FIG. 16 F shows how protecting an item within the cavity is useful, with the option to pinch and twist the tubular device from the outside to clean and polish the item placed within FIG. 17A to FIG. 17 E show the versatility of sizes, styles and options of using the tubular device FIG. 17 A shows how the openings have been slightly adhered together to make the opening smaller and provide a rim, or lip at the openings FIG. 17 B shows a tube which has been cinched with a fastener, and attached a clip and how one portion allows a golf club to be inserted to be wiped clean and the opposing side has a patch of a differing material on the outside and the tubular towel to insert items into as well as a differing wiping surface on the exterior FIG. 17 C shows a larger tubular device pulled onto a user's head FIG. 17 D shows how the tubular device is twisted, and tightened onto the head of the user FIG. 17 E shows an item inserted into the cavity and the shifting of the tube over the item placed within said cavity FIGS. 18 A to 18C show other options of use and styles of the tubular device FIG. 18A shows how two pockets are formed by turning back the openings of the device FIG. 18 B shows a tube is marked for labeling its use and accompanies the product it will be used with being a spray can in this view FIG. 18 C shows labeling tubular device for its use and with an attached loop hanging for hanging off of the spray bottle it accompanies FIGS. 19A to 19 C show ways to use the tubular device FIG. 19A shows an oven mitt formed by curling the tubular end onto the palm of the user FIG. 19 B shows a small tube filled with a exfoliating wash for small circular motions on delicate surfaces such as skin FIG. 19 C shows another method of using the Tubular Towel Device FIG. 19D shows an item inserted within the cavity and stored inside and secured by folding the openings of tubular device over the tube The tube may be flipped over with the weight of the item sealing the folded ends FIG. 19 E shows an item inserted with the cavity of the tubular device and the ends twisted to secure the item within FIGS. 20A to 20 D show how a long tube can be used FIG. 20 A shows a long tubular device that would shimmy and see-saw across a user's back with a bathing-hygiene formed tube of a scratchy material for exfoliating FIG. 20 B shows a tube with a pocket for filling with a product for hygiene cleaning and care FIG. 20 C shows a tubular device with cord and handles attached FIG. 20 D shows a user shimming the tubular device across their back

Advantages

From the description above, a number of advantages of my Reversible Tube Towel Device become evident:

(a) The cylindrical structure of my Reversible Tube Towel Device provides inside access to the user's hand for control and maneuverability as well as easy access for turning the towel inside out.

(b) Better control helps diminish hand fatigue.

(c) Both inside and outside of my Reversible Tube Towel Device is utilized for efficient usage of all surfaces. When the outside is soiled, the towel is simply turned inside out for fresh unsoiled area.

(d) My Reversible Tube Towel Device may be used partially turned inside out for doubling the thickness while controlled from within.

(e) My Reversible Tube Towel Device may be laid flat and used in the manner of any other conventional towel without folding for extra thickness.

(f) My Reversible Tube Towel Device can be color or pattern delineated to help the user identify soiled areas in order to discourage possible cross-contamination.

(g) My Reversible Tube Towel Device is simply removed and reversed and put back onto the hand, tool, or item that was placed within the cavity, when the end of the tube is soiled (h) My Reversible Tube Towel Device is easily shortened in length by tucking the end portion downward into the cavity of the tube (I) My Reversible Tube Towel Device is flipped and rotated easily onto and off a user's hand, tools, or foot for cleaning with a tubular device on a user's foot, as shuffling and swiping along to clean or polish a floor Although the description above contains many specificities, these should not be construed as limiting the scope of the invention but as merely providing illustrations of some of the presently preferred embodiments of this invention. For example, the design lends itself to unlimited adaptations in size, materials and surface treatments.

Thus the scope of the invention should be determined by the appended claims and their legal equivalents, rather than by the examples given.

I claim:

1. A method of dusting, wiping, washing, scrubbing, drying, applying, exfoliating, polishing, brushing, swooshing, protecting, brushing, stroking, sanding, transporting, shuffling, leveraging, extending and general cleaning, and superior control and maneuverability in a towel that ergonomically responds to a user's hand comprising the steps of;

providing an open-ended, multi-function, elongated tubular cleaning device, having openings at each end for entry and exit, providing a tubular cavity of access of exterior and interior surfaces which interface, each said opening providing entrance into one or both openings of the tubular cavity, each said opening being open ended as cylindrical in shape forming an elongated tube configuration and free of an elasticized bands at either opening, formed from a non pre existing material as in knitted, or from a pre existing material into as few as a single layer elongated cylinder, and having only two openings, similarly sized, void of any closures, void of securement means at either opening, and can be free of surfactants;

providing for an open-ended un obstructed tube configuration which allows for a tool or a hand to be inserted into as few as one of either end of the tubular cleaning device with the option to switch ends when one is soiled and the tubular-cleaning-device may then be turned inside out to expose a fresh clean surface and to be reused to provide a tubular cleaning device that can optionally encompass a user's hand or a tool;

wherein the entire tubular cleaning device turns inside out to provide a fresh clean surface;

inserting a user's hand into the tubular cleaning device forming a hand enclosure such that the user's hand makes contact with said cavity and tension can occur or tension with expansion occurs when the user's thumb and fingers are extended providing optimum control and maneuverability;

whereby the tubular cleaning device provides immediate access and egress means for a user's entire hand or forearm;

inserting a user's hand into the tubular cleaning device wherein the tubular cavity is controlled by a user's fingertips by wadding, pinching, tucking, and extending the fingertips;

inserting a user's hand into the tubular cleaning device wherein the tubular cavity is controlled by a user's fingertips by wadding, pinching, tucking, and extending the fingertips;

inserting a tool into the tubular cleaning device, to enclose the tool with the tubular cleaning device covering the tool;

whereby the user can manipulate the tool with the tubular cleaning device over the tool in order to provide extra reach to dust, wipe, wash, scrub, dry, polish, sand, brush, paint, stroke, shuffle on a surface and general cleaning;

inserting a user's hand, arm, or a tool into the tubular cleaning device whereby the user may transport the tubular cleaning device;

wherein the user's forearm is in the tubular cavity of the tubular cleaning device, or the tubular cleaning device is draped over the user's fore arm, for ready recall for general cleaning;

inserting a tool into the tubular cleaning device for extra reach to clean with the tubular cleaning device;

manipulating the tubular cleaning device exteriorly and interiorly with the user's entire hand, or a tool;

whereby the tubular cleaning device provides for utilizing the tubular cleaning device as a hand held towel as well as a tool pad for a tool or apparatus;

exchanging surface areas of the tubular cleaning device to expose a fresh, clean surface in order to utilize all portions of the tubular cleaning device as the surface areas becomes soiled, wherein the tubular cleaning device may also be reversibly turned inside out, and may also be reversibly turned end to end, when soiled, to expose a fresh clean surface, and repositioning the tubular cleaning device on a user's hand by partially reverse folding the cavity to expose a clean area and wisp away the soiled area, and reversing the position of the openings of the tubular cleaning device covering a tool end to end;

whereby a new cleaning portion of the tubular cleaning device is available and whereby the covered tool is exposed and then again enclosed;

depositing the tubular cleaning device on a user's person or stationary object when not in use depositing the tubular cleaning device onto a wrist or forearm of the user when not in service and between usages, wherein the tubular cleaning device remains in place on the wrist or forearm of the user for ready recall, as needed, in-order to dust, wipe, clean, polish, scrub, dry polish, sand, exfoliate, swipe, brush, protect, shuffle, and general cleaning;

repositioning the tubular cleaning device from the user's forearm or wrist area to the user as needed in order to provide for cleaning using the tubular wiping device interiorly or exteriorly or both interior and exterior surfaces at the same time to the user;

removing the tubular cleaning device from a user's hand or a tool which is inserted into the tubular cleaning device to reverse the tubular cleaning device end to end and re inserting the user's hand or a tool into the tubular cleaning device to provide a fresh clean surface;

removing the tubular cleaning device from a user's hand or a tool which is inserted within the tubular cleaning device to turn the tubular cleaning device inside out and re inserting the user's hand or a tool to provide a fresh clean surface for general cleaning and wiping;

removing the tubular cleaning device from a user's hand or from a tool inserted with in the tubular cleaning device and reversing the tubular cleaning device end to end and turning the tubular cleaning device inside out to provide a fresh clean surface for general cleaning and wiping;

removing the user's hand or a tool from the exterior of the tubular cleaning device to turn the tubular cleaning device inside out, as well as reversing the tubular cleaning device end to end to prove a fresh cleaning surface to the user's hand or tool for general cleaning and wiping;

inserting a user's entire hand and wrist into the tubular cleaning device and curling the user's fingers for clutching the tube's opening and up into said user's hand providing an excess of wiping material for covering the user's hand;

inserting a tool into the tubular cleaning device and enclosing the tool with the tubular cleaning device covering the tool whereby the user can manipulate the tool with the tubular cleaning device over it, or partially over it providing extended reach;

moving the tubular cleaning cloth from a user's hand and depositing the tubular cleaning device onto the wrist or forearm of the user when not in service and between usages, wherein the tubular cleaning cloth remains in place on the wrist or forearm, of the user for ready recall, as needed, in order to dust, wipe, wash, scrub, dry, or polish a surface and general cleaning;

transporting and depositing and draping the tubular cleaning device onto various areas of a person's body, to rest when not in use;

recalling readily the tubular wiping device into use by moving the tubular wiping device to a user's hand using the interior and exterior at the same time as well as accessing and manipulating multiple portions of the interior and exterior at the same time for cleaning, recalling readily the tubular wiping device from resting on a stationary device such as a vacuum handle, and using the tubular wiping device for cleaning, inserting two hands of a user, one hand into each of the two opening into the tubular wiping device for leveraged extra scrubbing power, grasping one of each openings of the tubular wiping device with opposing hands providing leverage for two hands for polishing, tucking the tubular cleaning device into itself;

where by providing a partially folded area of said tubular cleaning device over, and onto its self to provide a fresh clean surface wherein the cavity of the tubular cleaning device's material is then enclosing a user's hand, and as well as providing a fresh, as exterior cleaning surface; and a shortened length of the surface areas interiorly and exteriorly at the same time;

whereby providing a thickened form with two exterior openings at the entrance into the tubular wiping device, providing shortening of tubular cleaning device length by tucking one of said opening into said cavity;

inserting a user's hand, fingers and fingertips from either said opening, tucking the tubular cleaning device into the tubular cavity;

where by providing a protective covering;

wiggling the tubular cavity from within with the user's hand and providing a clean unused surface while the exterior is over covered by the interior portion wiggling downward.

* * * * *